US006227016B1

(12) United States Patent
Yu

(10) Patent No.: US 6,227,016 B1
(45) Date of Patent: May 8, 2001

(54) CABLE LOCK ASSEMBLY

(76) Inventor: Chun Te Yu, No. 41-21, Guan Tso Street, Fu Shing, Chang-Hwa (TW), 506

( * ) Notice: Subject to any disclaimer, the term of this patent is extended or adjusted under 35 U.S.C. 154(b) by 0 days.

(21) Appl. No.: 09/531,509

(22) Filed: Mar. 21, 2000

(51) Int. Cl.[7] ..... E05B 37/02
(52) U.S. Cl. ..... 70/30; 70/52
(58) Field of Search ..... 70/30, 52, 18, 70/58

(56) References Cited

U.S. PATENT DOCUMENTS

| | | | | |
|---|---|---|---|---|
| 561,524 | * | 6/1896 | Root | 70/30 |
| 616,647 | * | 12/1898 | Woodward | 70/30 |
| 839,795 | * | 12/1906 | Wilcox | 70/52 |
| 1,051,139 | * | 1/1913 | Lovett | 70/52 |
| 1,139,986 | * | 5/1915 | Lovett | 70/52 |
| 3,297,333 | * | 1/1967 | Schwedt et al. | 70/30 |
| 4,819,464 | * | 4/1989 | Kuo | 70/49 X |
| 5,560,232 | * | 10/1996 | Chen | 70/30 |
| 5,755,121 | * | 5/1998 | Crass | 70/52 |
| 5,786,759 | * | 7/1998 | Ling | 70/30 X |
| 5,868,012 | * | 2/1999 | Chun-Te et al. | 70/30 |
| 5,918,489 | * | 7/1999 | Yang | 70/52 X |

FOREIGN PATENT DOCUMENTS

| | | | | |
|---|---|---|---|---|
| 2240578 | * | 8/1991 | (GB) | 70/30 |

* cited by examiner

*Primary Examiner*—Lloyd A. Gall
(74) *Attorney, Agent, or Firm*—Rosenberg, Klein & Lee

(57) ABSTRACT

A cable lock assembly includes a lock body having a first casing, and a second casing securely coupled with the first casing and defining a locking groove which includes an insertion hole, and an elongated retaining slot connecting to the insertion hole and having a dimension smaller than that of the insertion hole, and a flexible cable having a first end secured to the second casing, and a second end including a locking block detachably received in the locking groove.

9 Claims, 6 Drawing Sheets

CABLE LOCK ASSEMBLY

BACKGROUND OF THE INVENTION

1. Field of the Invention

1. The present invention relates to a cable lock assembly.

2. Description of the Related Art

A conventional cable lock in accordance with the prior art shown in FIG. 12 comprises two casings 50 coupled with each other, an insertion hole 52 defined by the two casings 50, an elongated guide slot 54 having a smaller size defined by the two casings 50 and connecting to the insertion hole 52, and a flexible cable having a first end 42 secured between the two casings 50, and a second end 40 extending into the guide slot 54 through the insertion hole 52 and including an enlarged head 44 retained by the bottom of the guide slot 54.

However, a tool such as a screwdriver can be inserted into a space "S" between the insertion hole 52 and the guide slot 54 to press the two casings 50 outward so as to increase the dimension of the guide slot 54. When the size of the guide slot 54 is increased to exceed the diameter "W" of the enlarged head 44 of the second end 40 of the cable, the enlarged head 44 will be easily pulled to detach from the guide slot 54.

SUMMARY OF THE INVENTION

In accordance with one aspect of the present invention, there is provided a cable lock assembly comprising a lock body including a first casing, and a second casing securely coupled with the first casing and defining a locking groove which includes an insertion hole, and an elongated retaining slot connecting to the insertion hole and having a dimension smaller than that of the insertion hole; and a flexible cable having a first end secured to the second casing and a second end including a locking block detachably received in the locking groove. The locking block of the cable has a size equal to that of the insertion hole and greater than that of the retaining slot.

The first casing has a top edge defining a depression, and the second casing has a top edge including a top plate protruding outward and secured in the depression, and a plurality of reinforcing ribs each mounted on a bottom of the top plate.

The cable lock assembly further comprises an upright number wheel set mounted in the lock body and including a sleeve secured in the lock body, an actuating rod movably mounted in the sleeve, and a support plate secured on a top end of the actuating rod to move therewith; and a closing block supported on the support plate to move therewith and located under the insertion hole of the locking groove for detachably closing the insertion hole.

The number wheel set further includes a plurality of dials rotatably mounted on the sleeve for controlling movement of the actuating rod, and a biasing member mounted on the actuating rod and urged between the support plate and a top one of the dials.

The lock body includes a pivot shaft secured to the second casing, and the closing block defines an elongated guide slot for receiving the pivot shaft.

The support plate has one end including a side wall extending upward, and a first inclined surface located between the side wall and the support plate, and the closing block includes an abutting lug extending outward and having a second inclined surface detachably abutting the first inclined surface of the support plate.

The lock body includes a pivot axle secured to the second casing, and the cable lock assembly further comprises a torsion spring pivotally mounted on the pivot axle and having a first end secured in the lock body and a second end detachably abutting the closing block.

Further benefits and advantages of the present invention will become apparent after a careful reading of the detailed description with appropriate reference to the accompanying drawings.

DETAILED DESCRIPTION OF THE INVENTION

Figure 1:
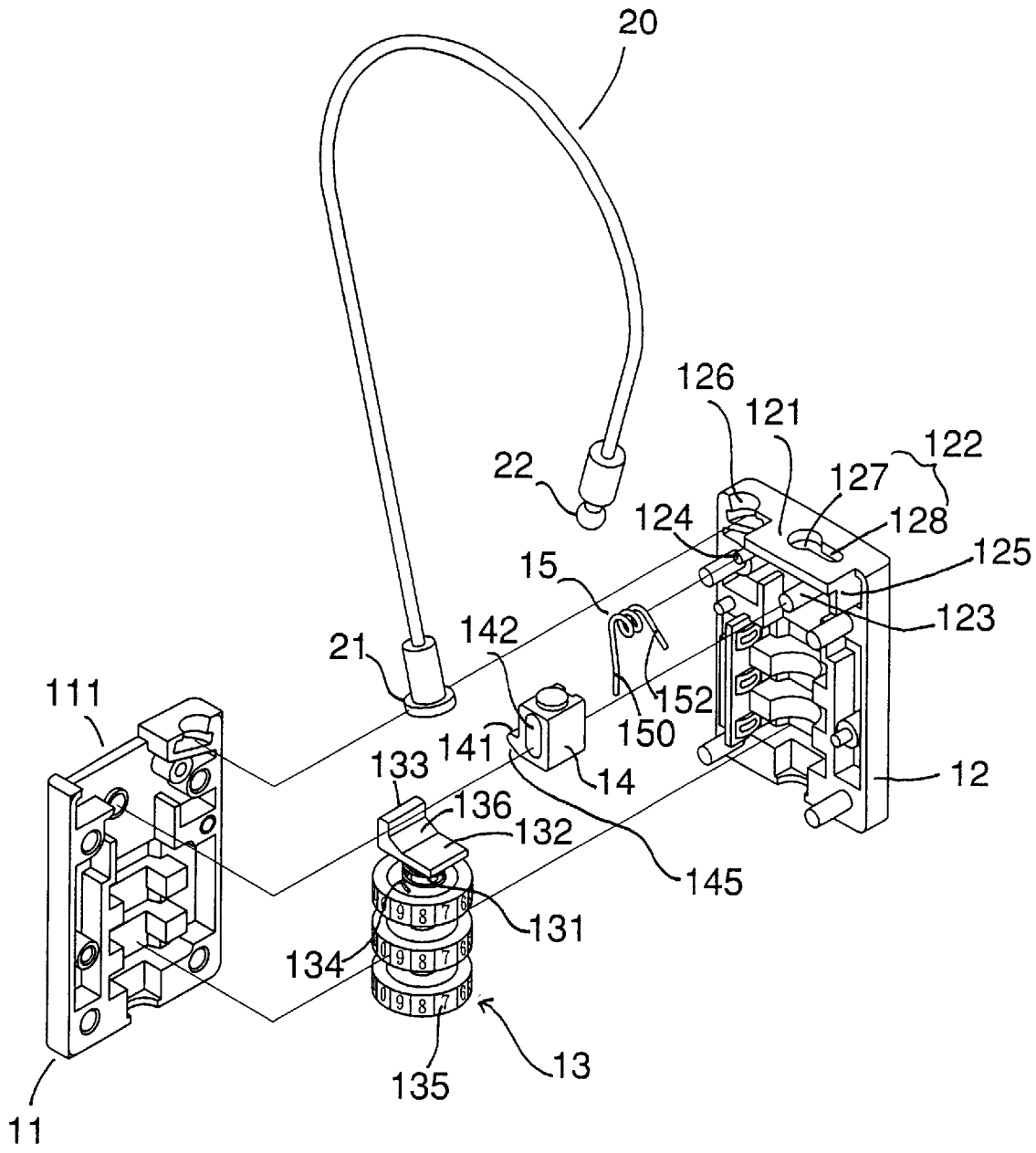
FIG. 1 is an exploded view of a cable lock assembly in accordance with the present invention.
Figure 2:
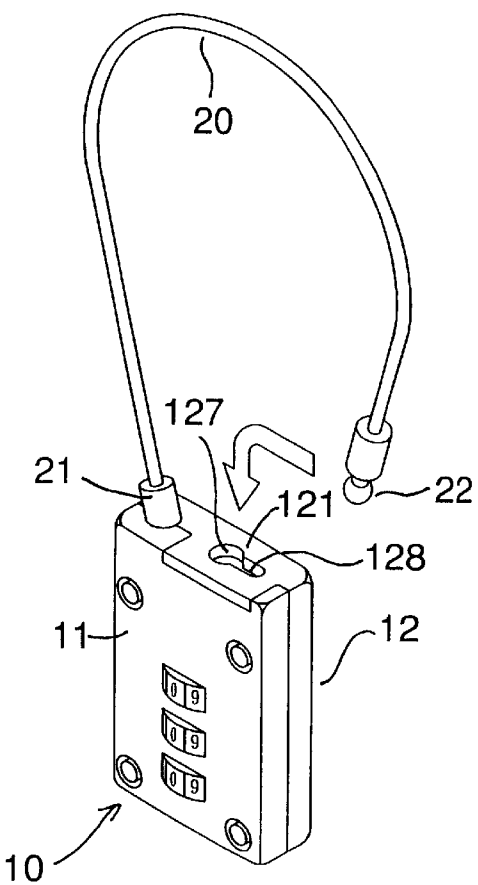
FIG. 2 is a perspective assembly view of the cable lock assembly as shown in FIG. 1.
Figure 3:
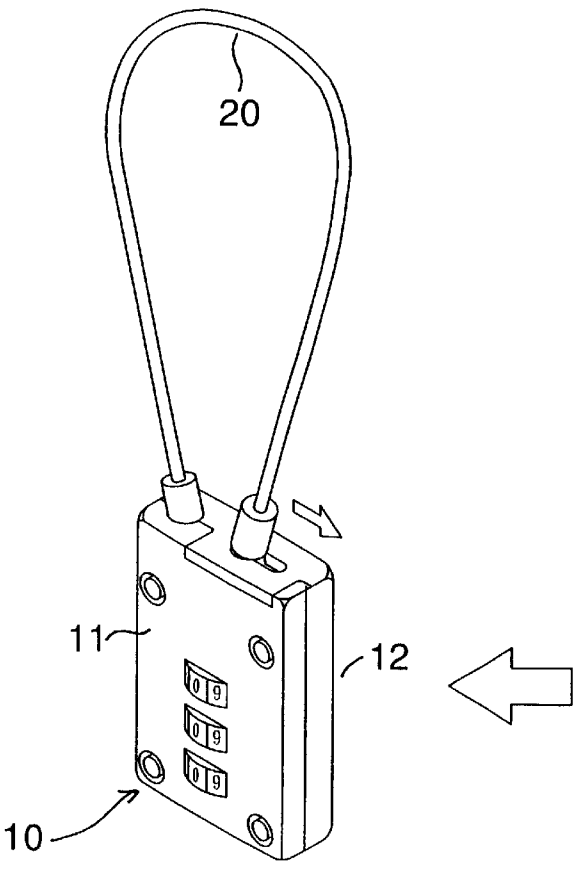
FIG. 3 is an operational view of the cable lock assembly as shown in FIG. 2.

Referring to the drawings and initially to FIGS. 1-5, a cable lock assembly in accordance with the present invention comprises a lock body 10 including a first casing 11, and a second casing 12 securely coupled with the first casing 11 and defining a locking groove 122 including an insertion hole 127, and an elongated retaining slot 128 connecting to the insertion hole 127 and having a dimension smaller than that of the insertion hole 127, and a flexible cable 20 having a first end secured to the second casing 12, and a second end including a locking block 22 detachably received in the locking groove 122 and retained by the retaining slot 128. The locking block 22 of the cable 20 has a size equal to that of the insertion hole 127 and greater than that of the retaining slot 128 so that the locking block 22 can extend through the insertion hole 127, and can be retained by the retaining slot 128.

The first casing 11 has a top edge defining a depression 111, and the second casing 12 has a top edge including a top plate 121 protruding outward and secured in the depression 111, and a reinforcing rib 125 each mounted on a bottom of the top plate 121 for reinforcing the strength of the top plate 121. The locking groove 122 is integrally defined in the top plate 121. The top plate 121 of the second casing 12 also defines a fixing recess 126, and the first end of the cable 20 includes a fixed block 21 secured in the fixing recess 126.

The cable lock assembly further comprises an upright number wheel set 13 mounted in the lock body 10 and including a sleeve 130 secured in the lock body 10, an actuating rod 131 movably mounted in the sleeve 130, and a support plate 132 secured on a top end of the actuating rod 131 to move therewith, and a closing block 14 supported on the support plate 132 to move therewith and located under the insertion hole 127 of the locking groove 122 for detachably closing the insertion hole 127.

The lock body 10 includes a pivot shaft 123 secured to the second casing 12, and the closing block 14 defines an elongated guide slot 142 for receiving the pivot shaft 123 so that the closing block 14 is pivotally and slidably mounted on the pivot shaft 123.

The number wheel set 13 further includes a plurality of dials 135 rotatably mounted on the sleeve 130 for controlling movement of the actuating rod 131, and a biasing member such as a restoring spring 134 mounted on the actuating rod 131 and urged between the support plate 132 and a top one of the dials 135.

The support plate 132 has one distal end including a side wall 133 vertically extending upward, and a first inclined surface 136 located between the side wall 133 and the support plate 132, and the closing block 14 includes an abutting lug 141 extending outward and having a second inclined surface 145 detachably abutting the first inclined surface 136 of the support plate 132.

The lock body 10 includes a pivot axle 124 secured to the second casing 12, and the cable lock assembly further comprises a torsion spring 15 pivotally mounted on the pivot axle 124 and having a first end 150 secured in the lock body 10 and a second end 152 detachably abutting the closing block 14.

Figure 4:
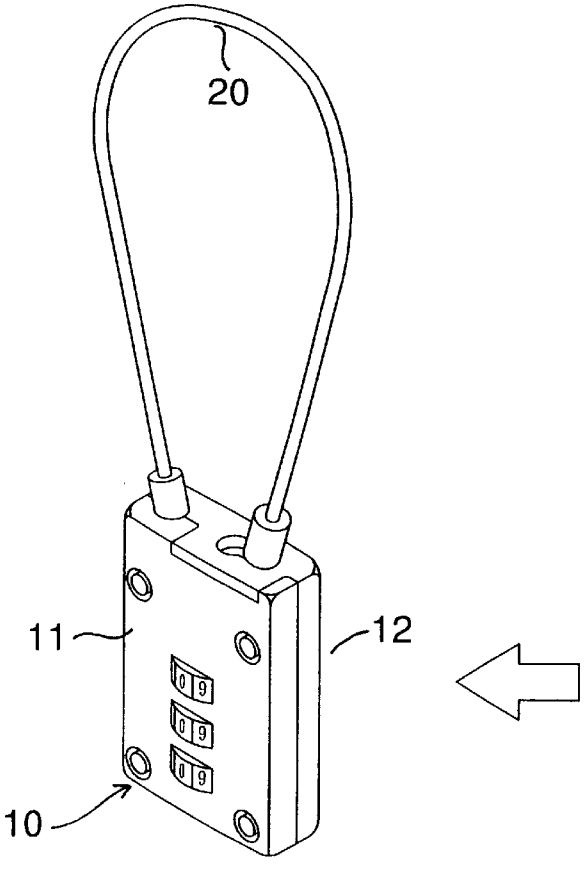
FIG. 4 is an operational view of the cable lock assembly as shown in FIG. 3.
Figure 5:
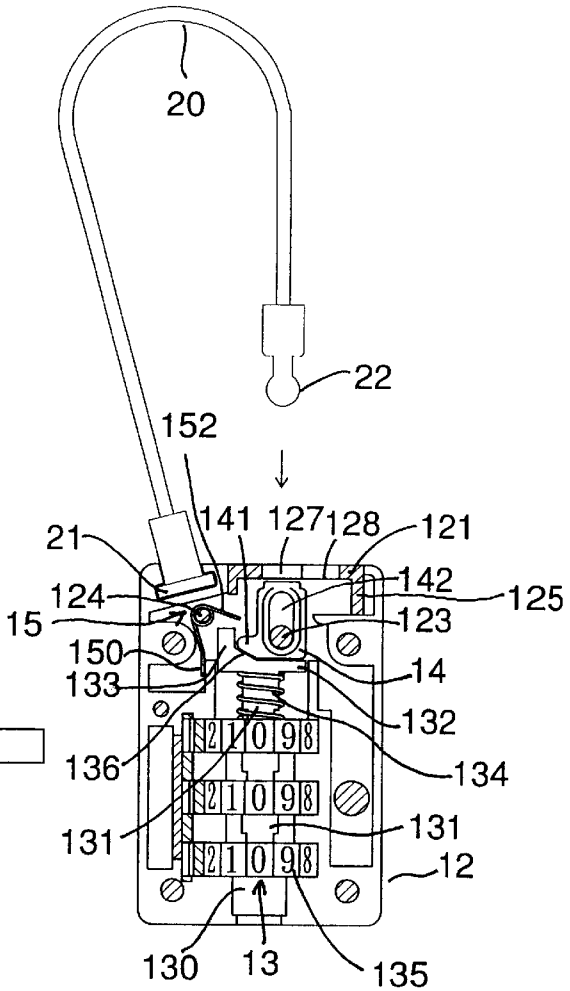
FIG. 5 is a front plan cross-sectional view of the cable lock assembly as shown in FIG. 2.

In operation, referring to FIGS. 2–10 with reference to FIG. 1, the actuating rod 131 is initially fixed in the sleeve 130 so that the closing block 14 is fixed in the lock body 10 to close the insertion hole 127 as shown in FIG. 5. When each of the dials 135 of the number wheel set 13 is rotated to a right position, the actuating rod 131 can be moved in the sleeve 130 so that the closing block 14 is movable on the pivot shaft 123.

Figure 6:
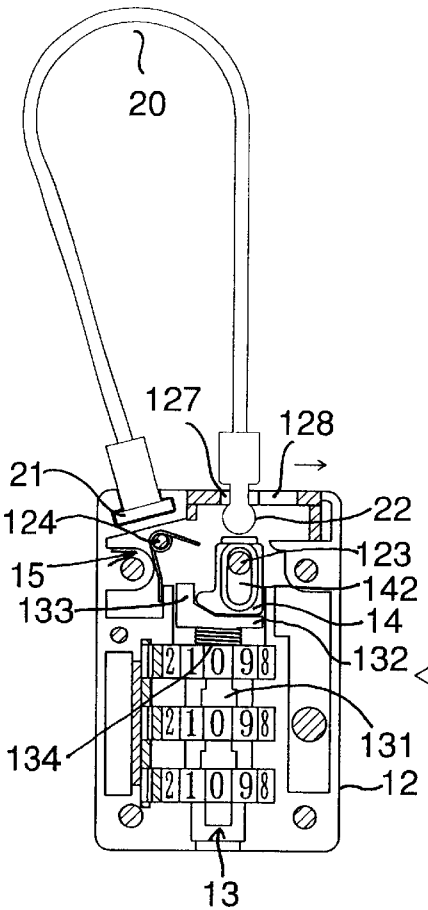
FIG. 6 is an operational view of the cable lock assembly as shown in FIG. 5.

The locking block 22 of the flexible cable 20 is then moved toward the top plate 121 of the second casing 12 to extend through the insertion hole 127 of the locking groove 122, thereby pressing the closing block 14 which is moved downward from the position as shown in FIG. 5 to the position as shown in FIG. 6.

Figure 7:
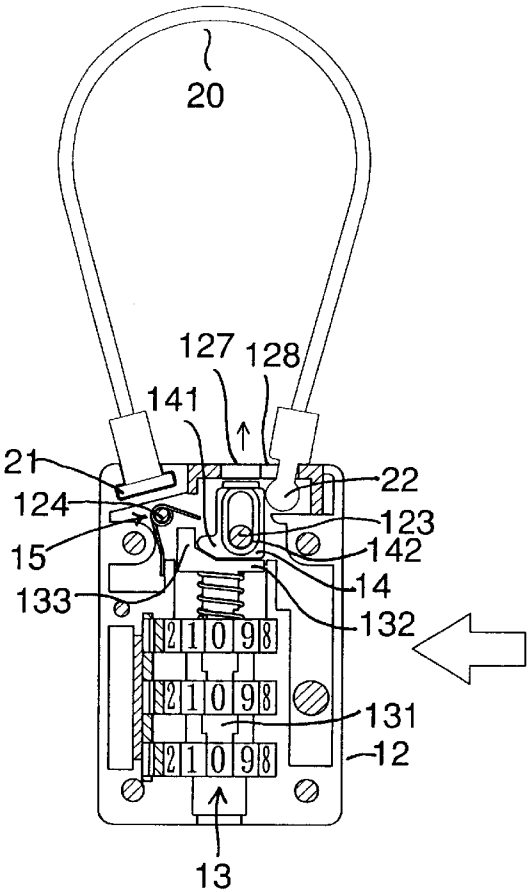
FIG. 7 is an operational view of the cable lock assembly as shown in FIG. 6.

The locking block 22 is then moved into and limited by the retaining slot 128 as shown in FIGS. 4 and 7 by means of the elastic action of the flexible cable 20. The closing block 14 is then moved upward by the restoring force of the restoring spring 134 from the position as shown in FIG. 6 to the position as shown in FIG. 7 so as to close the insertion hole 127, thereby preventing the locking block 22 from detaching from the insertion hole 127.

The dials 135 of the number wheel set 13 can then be rotated to fix the actuating rod 131 in the sleeve 130 so that the closing block 14 is fixed in the lock body 10 to close the insertion hole 127 as shown in FIG. 7, thereby locking the locking block 22 in the lock body 10.

Figure 8:
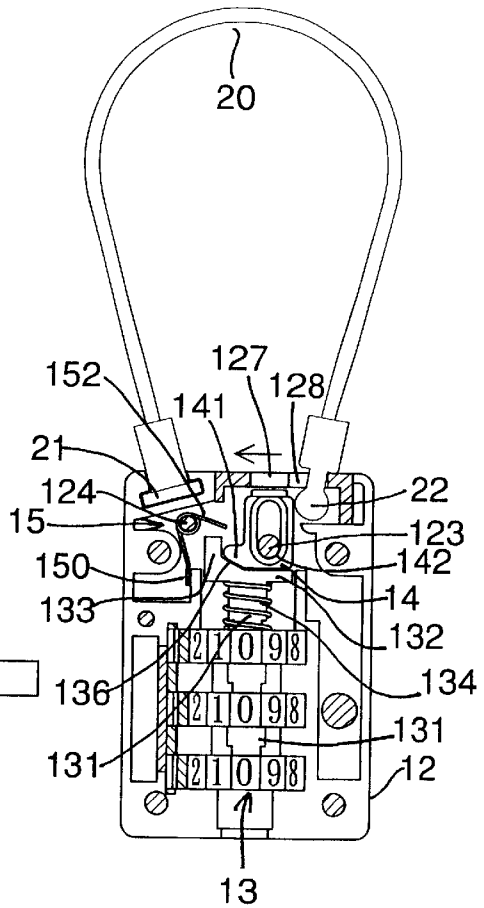
FIG. 8 is an operational view of the cable lock assembly as shown in FIG. 7.
Figure 9:
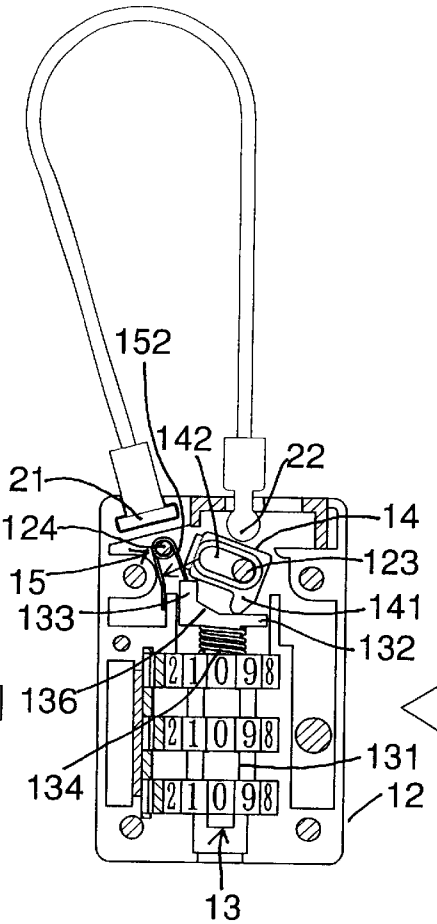
FIG. 9 is an operational view of the cable lock assembly as shown in FIG. 8.

When each of the dials 135 of the number wheel set 13 is again rotated to a right position, the actuating rod 131 can be moved in the sleeve 130 so that the closing block 14 is movable and rotatable on the pivot shaft 123. The locking block 22 is then moved toward the insertion hole 127 to press the closing block 14 which is rotated on the pivot shaft 123 from the position as shown in FIG. 8 to the position as shown in FIG. 9. During rotation of the closing block 14, the second end 152 of the torsion spring 15 is biased by the top edge of the closing block 14, and the support plate 132 together with the actuating rod 131 is moved downward by the abutting lug 141 as shown in FIG. 9, thereby compressing the restoring spring 134.

Figure 10:
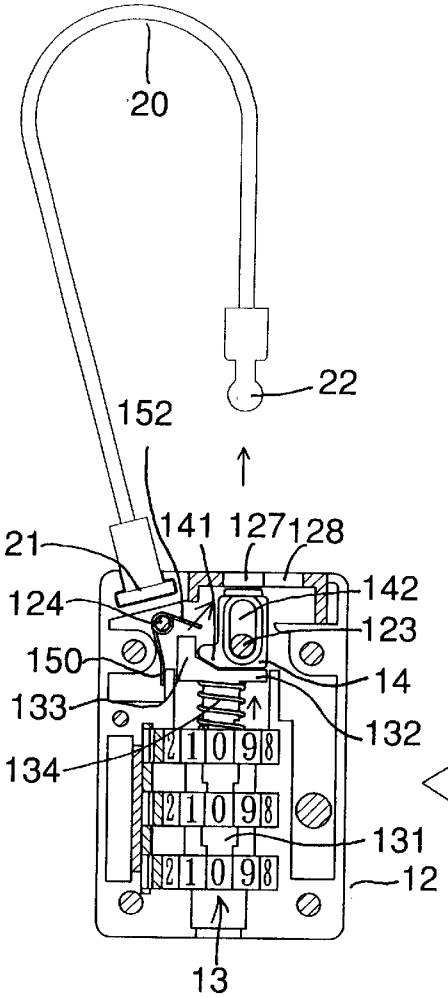
FIG. 10 is an operational view of the cable lock assembly as shown in FIG. 9.

The locking block 22 is then detached from the insertion hole 127 as shown in FIG. 10. When the locking block 22 is detached from the insertion hole 127, the closing block 14 is then rotated on the pivot shaft 123 from the position as shown in FIG. 9 to the position as shown in FIG. 10 by means of the restoring force of the torsion spring 15 and the restoring spring 134.

Figure 11:
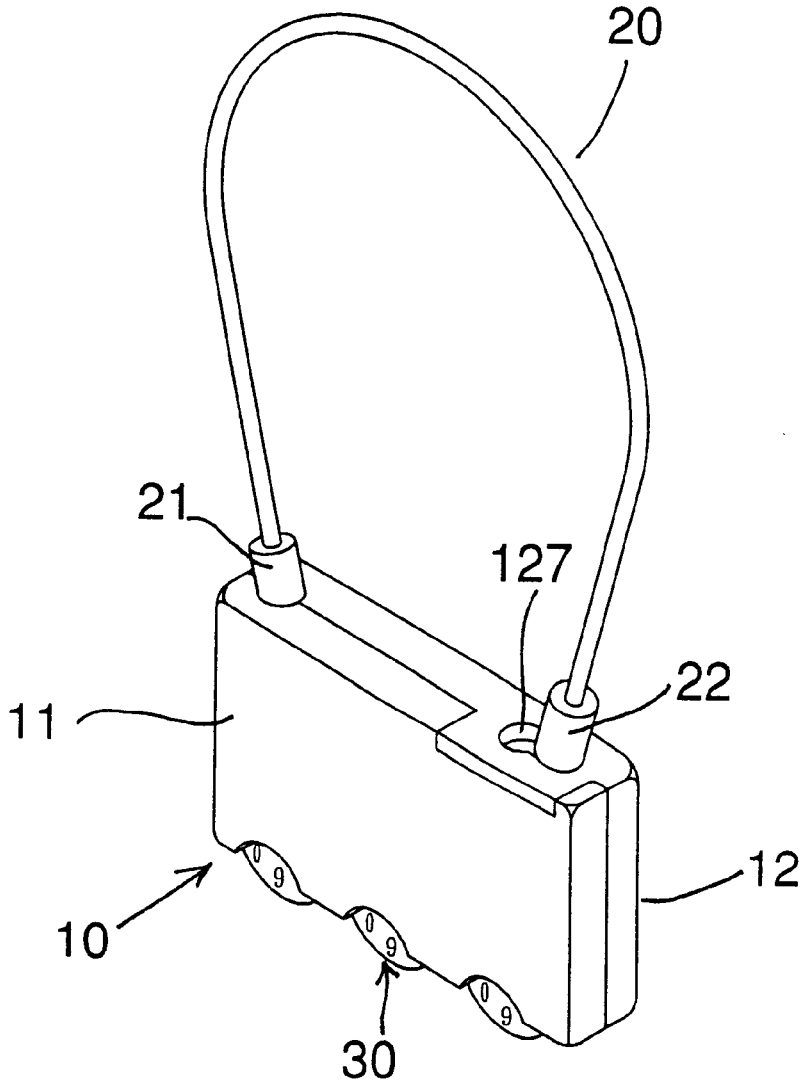
FIG. 11 is a perspective view of a cable lock assembly in accordance with another embodiment of the present invention.
Figure 12:
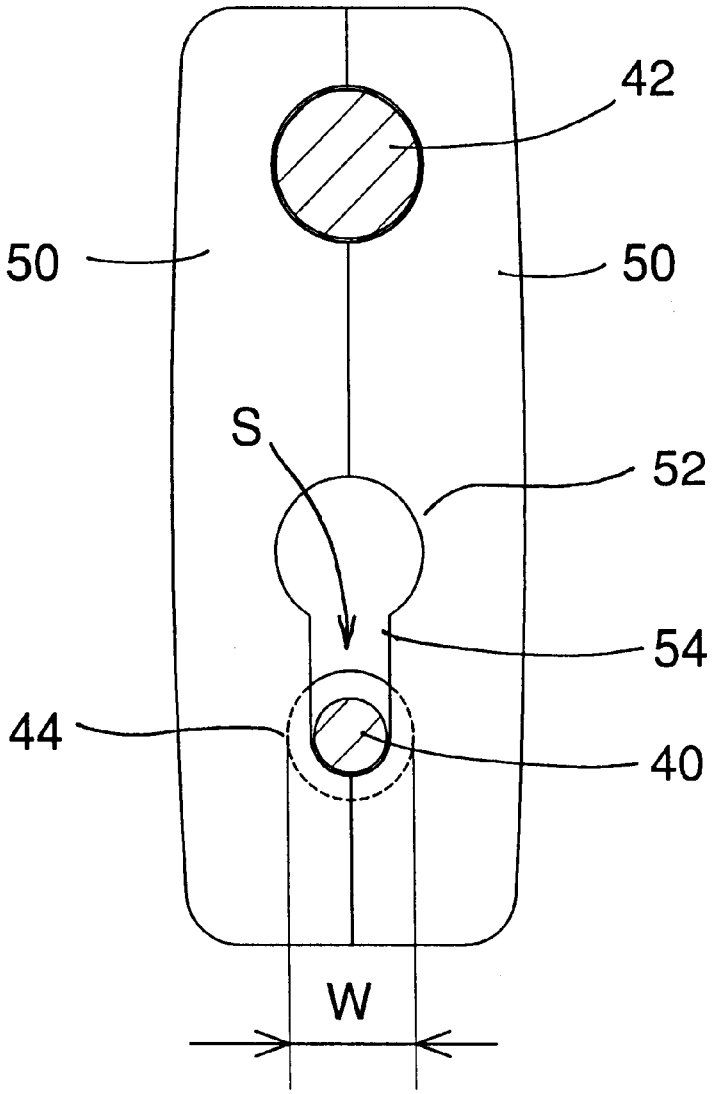
FIG. 12 PRIOR ART
FIG. 12 is a top plan cross-sectional assembly view of a conventional cable lock in accordance with the prior art.

Referring to FIG. 11, in accordance with another embodiment of the present invention, the lock body 10 can be adapted to fit a horizontal number wheel set 30.

Accordingly, the locking groove 122 is directly and entirely fitted in the second casing 12, and is not formed by the first casing 11 and the second casing 12 co-operating with each other. In addition, the strength of the top plate 121 is reinforced by the reinforcing ribs 125 so that the locking groove 122 cannot be damaged easily, thereby achieving an anti-theft effect.

It should be clear to those skilled in the art that further embodiments may be made without departing from the scope of the present invention.

What is claimed is:

1. A cable lock assembly comprising:

a lock body (10) including a first casing (11), and a second casing (12) securely coupled with said first casing (11) and defining a locking groove (122), said locking groove (122) including an insertion hole (127), and an elongated retaining slot (128) connecting to said insertion hole (127) and having a dimension smaller than that of said insertion hole (127);

a flexible cable (20) having a first end secured to said second casing (12), and a second end including a locking block (22) detachably received in said locking groove (122);

an upright number wheel set (13) mounted in said lock body (10) and including a sleeve (130) secured in said lock body (10), an actuating rod (131) movably mounted in said sleeve (130), and a support plate (132) secured on a top end of said actuating rod (131) to move therewith; and a closing block (14) supported on said support plate (132) to move therewith and located under said insertion hole (127) of said locking groove (122).

2. The cable lock assembly in accordance with claim 1, wherein said locking block (22) of said cable (20) has a size equal to that of said insertion hole (127) and greater than that of said retaining slot (128).

3. The cable lock assembly in accordance with claim 1, wherein said first casing (11) has a top edge defining a depression (111), and said second casing (12) has a top edge including a top plate (121) protruding outward and secured in said depression (111).

4. The cable lock assembly in accordance with claim 3, wherein said second casing (12) includes a reinforcing rib (125) mounted on a bottom of said top plate (121).

5. The cable lock assembly in accordance with claim 3, wherein said top plate (121) of said second casing (12) defines a fixing recess (126), and said first end of said cable (20) includes a fixed block (21) secured in said fixing recess (126).

6. The cable lock assembly in accordance with claim 1, wherein said number wheel set (13) further includes a plurality of dials (135) rotatably mounted on said sleeve (130) for controlling movement of said actuating rod (131), and a biasing member (134) mounted on said actuating rod (131) and urged between said support plate (132) and a top one of said dials (135).

7. The cable lock assembly in accordance with claim 1, wherein said lock body (10) includes a pivot shaft (123) secured to said second casing (12), and said closing block (14) is pivotally mounted on said pivot shaft (123) and defines an elongated guide slot (142) for receiving said pivot shaft (123).

8. The cable lock assembly in accordance with claim 1, wherein said support plate (132) has one end including a side wall (133) extending upward, and a first inclined surface (136) located between said side wall (133) and said support plate (132), and said closing block (14) includes an abutting lug (141) extending outward and having a second inclined surface (145) detachably abutting said first inclined surface (136) of said support plate (132).

9. The cable lock assembly in accordance with claim 1, wherein said lock body (10) includes a pivot axle (124) secured to said second casing (12), and said cable lock assembly further comprises a torsion spring (15) pivotally mounted on said pivot axle (124) and having a first end (150) secured in said lock body (10) and a second end (152) detachably abutting said closing block (14).

* * * * *